US006159622A

United States Patent [19]

Hori et al.

[11] Patent Number: 6,159,622

[45] Date of Patent: Dec. 12, 2000

[54] GALVANNEALED STEEL SHEET AND MANUFACTURING METHOD THEREOF

[75] Inventors: Masahiko Hori, Nishinomiya; Toshio Nakamori, Ashiya; Keiji Miki, Amagasaki, all of Japan

[73] Assignee: Sumitomo Metal Industries, Ltd., Osaka, Japan

[21] Appl. No.: 08/913,302

[22] PCT Filed: Feb. 21, 1997

[86] PCT No.: PCT/JP97/00510

§ 371 Date: Sep. 11, 1997

§ 102(e) Date: Sep. 11, 1997

[87] PCT Pub. No.: WO97/31131

PCT Pub. Date: Aug. 28, 1997

[30] Foreign Application Priority Data

Feb. 22, 1996 [JP] Japan ..... 8-035166
Jul. 9, 1996 [JP] Japan ..... 8-179061

[51] Int. Cl.[7] ..... B32B 15/18; C21D 1/09

[52] U.S. Cl. ..... 428/659; 428/939; 427/433; 148/533

[58] Field of Search ..... 428/659, 939; 427/433; 148/533

[56] References Cited

U.S. PATENT DOCUMENTS 5,897,967 4/1999 Hori et al. ..... 428/659

FOREIGN PATENT DOCUMENTS 1-123058 5/1989 Japan .
2-97653 4/1990 Japan .
6-81080 3/1994 Japan .
6-81099 3/1994 Japan .

OTHER PUBLICATIONS

"Coating Microstructure Assessment and Control For Advanced Product Properties of Galvannealed IF Steels," by W. van Koesveld et al., *Galvatech '95 Conference Proceedings*(Sep. 17–21, 1995), pp. 343–355.

"Laboratory Investigations on the morphology of the Coating and the Forming Behavior of Galvannealed Steel Sheet," by R. Brisberger et al., *Galvatech '95 Conference Proceedings*(Sep. 17–21, 1995), pp. 753–759.

*Primary Examiner*—Timothy Speer
*Assistant Examiner*—Jason Resnick
*Attorney, Agent, or Firm*—Burns, Doane, Swecker & Mathis, LLP

[57] ABSTRACT

A galvannealed steel sheet having excellent powdering resistance during press forming and excellent chipping resistance in cold environments. The steel sheet has the following chemical composition, by weight, of C: up to 0.01%, Si: 0.03 to 0.3%, Mn: 0.05 to 2%, P: 0.017 to 0.15%, Al: 0.005 to 0.1%, Ti: 0.005 to 0.1%, Nb: up to 0.1 %, B: up to 0.005%, balance: Fe and incidental impurities. The average grain size of the surface of the base metal of the galvannealed steel sheet is 12 $\mu$m or less and the steel sheet is useful in the manufacture of automobiles.

17 Claims, No Drawings

GALVANNEALED STEEL SHEET AND MANUFACTURING METHOD THEREOF

FIELD OF THE INVENTION

The present invention relates to a galvannealed steel sheet suitable for use in automobiles, plated with a metallic coating having excellent powdering resistance and chipping resistance, as well as to a manufacturing method thereof.

BACKGROUND OF THE INVENTION

A galvannealed steel sheet has recently been in widespread use in various sectors of industry such as automobiles, electric home appliances, construction materials, and the like because of their excellent weldability, paintability, corrosion resistance, economic merits, and the like. A high strength galvannealed steel sheet having good press formability is also demanded from the viewpoint of promoting safety and weight reduction of automobiles. Therefore, the galvannealed steel sheet is required which can meet all of the aforesaid requirement.

Normally, the galvannealed steel sheet is manufactured by heating up a hot—dip galvanized steel sheet to a temperature in the range of 500 to 600° C. for a retention time of 3 to 60 seconds in a heating furnace for Fe—Zn alloying. By applying a Fe—Zn alloying treatment as above, a Zn layer composing an original metallic coating is turned into a Fe—Zn alloy layer containing normally 8 to 12 wt % of Fe. A coating weight of the metallic coating after the treatment, that is, a Fe—Zn alloy layer, is normally 20 to 70 g /$m^2$ of the surface on one side of the steel sheet.

In application of the galvannealed steel sheet for manufacturing automobile body parts, such properties as powdering resistance and chipping resistance are important. Powdering is a phenomenon in which the metallic coating is broken into fine pieces and exfoliated at sites where the steel sheet is subjected to compressive deformation during press forming, and the like. Not only corrosion resistance is degraded at sites of the steel sheet where powdering occurs, but also fine pieces of the exfoliated coating, adhered to press dies, give rise to a cause for surface defects of a formed product. Various measures have been adopted for preventing powdering, including reduction in a Zn coating weight, restriction on Al concentration in a plating bath, restriction on Fe—Zn alloying conditions and Fe content of a galvannealed coating.

Chipping is a phenomenon in which the galvannealed coating exfoliates from the surface of a base metal, occurring, for example, when pebbles, and the like, collide with a running automobile, and the impact force of the pebbles is applied to the painted surface of the automobile body. Automobiles in service in cold environments are susceptible to the chipping phenomena.

Since both powdering and chipping are phenomena whereby the galvannealed coating exfoliates, it has been considered that enhancement in powdering resistance would be accompanied by improvement in chipping resistance. However, it has since been found that enhanced powdering resistance does not necessarily result in improved chipping resistance, and adhesion property at the interface between the base metal and the galvannealed coating needs to be enhanced in order to improve chipping resistance.

For example, a method of manufacturing a galvannealed steel sheet focusing on improvement in the adhesive property at the interface between the base metal and the galvannealed coating is disclosed in Japanese Patent Publication Laid-open (Kokai) No. Hei 2-97653. The steel sheet according to the aforesaid invention has a micro-structure formed by diffusion of Zn into the grain boundaries on the surface of a base metal. The steel sheet described above is manufactured by plating a base metal in a hot-dip galvanizing bath containing Al in a concentration set much higher than for normal cases, and by applying the Fe—Zn alloying treatment at higher temperature than for normal cases. However, use of a plating bath containing Al in higher concentration requires application of the Fe—Zn alloying treatment at higher temperature and for longer period of time than for normal cases. Powdering resistance tends to be impaired when the Fe—Zn alloying is processed at higher temperature and a longer processing time results in a poorer productivity.

P added steel is in widespread use for manufacturing a high strength steel sheet for use in automobiles, because the strength of a steel sheet can be increased at low cost by adding P. However, an improvement in chipping resistance of the galvannealed steel sheet with an increased P content has been difficult to achieve. This is due to the fact that with higher P content, reactivity of Zn in grain boundaries of the base metal is impaired. Consequently, the effect of improving coating adhesion resulting from diffusion of Zn into grain boundaries on the surface of the base metal can not be expected with respect to a steel with a high P content.

Japanese Patent Laid-open (Kokai) Publication No. Hei 6-81099 discloses a steel sheet having excellent coating adhesion by holding down P content detrimental to chipping resistance at 0.007 wt % or lower, and by roughing the surface of the base metal at its boundary with the galvannealed coating. However, with said steel, Si and Mn are used in place of P to increase the strength. It is not a desirable means to increase Si and Mn contents as a substitution for limiting P content lower from the viewpoint of increasing tensile strength of the base metal economically.

It is reported in GALVATEC '95 CONFERENCE Proceedings (September 1995), p. 343 to 353 and p. 753 to 759, that coating adhesion at an interface between a base metal and a metallic coating is enhanced when Si is added to an ultra-low carbon steel with Ti added thereto because diffusion of Zn into grain boundaries of the base metal is promoted. However, the technology disclosed therein is intended for application to a soft ultra-low carbon steel while no mention was made of a P added steel sheet of high tensile strength, which is in great demand as steel sheet for use in automobiles.

SUMMARY OF THE INVENTION

A galvannealed steel sheet according to the present invention is a steel sheet having excellent powdering resistance during press forming, and excellent chipping resistance when products made of it are used in cold regions.

A base metal of the galvannealed steel sheet according to the invention consist essentially, on the basis of percent by weight, of:

C: up to 0.01%; Si: 0.03 to 0.3%;

Mn: 0.05 to 2%; P: 0.017 to 0.15%;

Al: 0.005 to 0.1%; Ti: 0.005 to 0.1%;

Nb: up to 0.15%; B: up to 0.005% %;

balance: Fe and incidental impurities.

Further, the galvannealed steel sheet according to the invention is a steel sheet wherein the average grain size on the surface of the base metal, at the interface between the base metal and the galvannealed coating, is 12 $\mu$m or less.

The galvannealed steel sheet according to the invention is manufactured with ease under the conditions described hereafter.

A portion of the surface of the base metal, namely, 1 to 8 $g/m^2$ is removed by grinding. Then, the surface of the base metal is reduced in a hydrogen containing atmosphere at high temperature. During such reduction heating, recrystallization annealing is applied to the base metal in case of need. In the cooling stage following such heating, the base metal is held in a temperature range of 600 to 500° C. for a retention time of 10 to 120 seconds, after that, the base metal is cooled down to a galvanizing temperature, and then hot-dip galvanized. Subsequently, the galvanized steel sheet is heated to a Fe—Zn alloying temperature with the velocity of 20° C./sec or more in the temperature range of 420 to 480° C.

DETAILED DESCRIPTION OF THE INVENTION

The inventors have examined methods of improving coating adhesion, in particular, chipping resistance of a galvannealed steel sheet using a highly economical P added steel with high strength as a base metal. The present invention has been completed on the basis of new information described hereafter, which is gained as a result of such examination.

The smaller the average grain size on the surface of the base metal of the galvannealed steel sheet, at the interface between the base metal and the galvannealed coating, the higher chipping resistance thereof becomes. The average grain size on the surface of the base metal needs to be reduced to 12 μm or less in order to obtain chipping resistance at a target level. In most cases of conventional galvannealed steel sheets, grain size on the surface of the base metal is in the range of 20 to 30 μm in diameter. Hence, the grain size on the surface of the base metal needs to be reduced to about a half or a third of that in the case of conventional products to achieve the coating adhesion at a preferable level. However, if the grain size is reduced throughout the thickness of the base metal, its formability is impaired. Therefore, it is difficult to attain high chipping resistance concomitant with good formability by a process condition, such that the grain size becomes fine throughout the thickness of the base metal.

Coating adhesion, particularly, chipping resistance of a galvannealed steel sheet using a P containing ultra-low carbon steel as its base metal, is substantially enhanced by adding Si to the base metal, and by controlling the cooling condition after reduction heating applied before galvanizing and conditions of Fe—Zn alloying treatment. With respect to the galvannealed steel sheet with substantially enhanced chipping resistance, the average grain size on the surface of the base metal is found to be much smaller than the grain size inside of the base metal.

Grinding of the surface of the base metal before the reduction heating is apt to promote localized formation of fine grain micro-structure on the surface of the base metal after the Fe—Zn alloying treatment. Even if coarse grains remained locally on the surface of the base metal, good coating adhesion is attained if fine grains are in other parts of the surface of the base metal. For example, even if the micro-structure is such a mixed one containing fine grains ranging from about 1 to 5 μm and coarser grains up to around 20 μm, chipping resistance is good provided that the average diameter of these grains is 12 μm or less. In addition, regions of good coating adhesion can be expanded to the area of lower Si content by grinding the surface of the base metal before reduction heating. Lowering of Si content is favorable to improve its formability and surface quality.

With respect to the galvannealed steel sheet according to the invention, the preferable range of the chemical composition of the base metal, metallic coating of the steel sheet and the micro-structure of the surface of the base metal are described hereafter. Reasons for specifying preferred manufacturing conditions are also described. A symbol "%" used in describing chemical composition of the steel and metallic coating denote percent by weight.

(A) Chemical Composition of the Base Metal

C: up to 0.01

Lower carbon content is better because carbon impairs formability of a steel sheet. In particular, if there is any stage of rapid cooling from high temperatures in its manufacturing process, carbon tends to remain in the form of solute C in the steel. In the case of excessive solute C remaining, strain aging of the steel sheet is promoted, and its mechanical properties tend to be impaired. Normally, excessive solute carbon is combined with Ti and Nb added to the steel. When C content becomes high, amounts of Ti and Nb added need to increase accordingly, resulting in higher production cost. Further, carbide, and the like, formed by addition of these elements impair formability of the steel sheet. Hence, C content is set at up to 0.01%.

Si: 0.03 to 0.3%

Addition of Si is intended to form fine grain structure on the surface of the base metal, at the interface between the base metal and the galvannealed coating. With Si content lower than 0.03%, fine grain structure on the surface of the base metal can not be formed. On the other hand, with Si content in excess of 0.3%, the base metal is susceptible to scale defects during the hot rolling of the base metal, and a non-plating phenomenon is apt to occur in the hot-dip galvanizing process. Hence, Si content is set in the range of 0.03 to 0.3%, preferably, 0.03 to 0.18%.

Mn: 0.05 to 2%

At least, 0.05% of Mn is required to prevent hot shortness caused by S, one of the incidental impurities. Mn is an element effective in increasing the strength of the steel sheet. So, Mn is added also to strengthen the steel sheet, but the effect reaches a saturation point when its content exceeds 2%. Addition of Mn in large amounts not only impairs the surface quality and formability of the base metal but also aggravates the economics of products. Hence, Mn content is set in the range of 0.05 to 2%.

P: 0.017 to 0.15%

P is added to increase the strength of steel sheet, because P strengthens the steel sheet effectively even if the amount of its addition is small. With P content at less than 0.017%, its effect as described above is insufficient. However, addition of P in large amounts renders steel brittle, and impairs metallic coating adhesion. Hence, the P content is set in the range of 0.017 to 0.15%, preferably, 0.02 to 0.04%.

Al: 0.005 to 0.1%

Al is added as deoxidizer in molten steel, and also to combine with N, one of incidental impurities, forming AlN. With Al content at less than 0.005%, its effect as described above is not sufficient. On the other hand, in the case of the Al content exceeding 0.1%, not only the effect reaches a saturation point but also the economics are impaired. Hence, the Al content is set in the range of 0.005 to 0.1%.

Ti: 0.005 to 0.1%

Ti is added to combine with solute C in the base metal, improving formability of the steel sheet. With Ti content at less than 0.005%, its effect as described above is insufficient, but in the case of exceeding 0.1%, the effect reaches a saturation point. Accordingly, addition of Ti exceeding 1% is not only uneconomical but also may sometimes be detrimental to formability. Hence, the Ti content is set in the range of 0.005 to 0.1%, preferably, 0.005 to 0.05%.

Nb: up to 0.1%

Although Nb is not among the essential elements, it is added as necessary because Nb has a similar effect to that of Ti, to combine with solute C, and to improve formability of the cold rolled and annealed steel sheet, by forming fine grained structures in hot rolled steel sheet. Since addition of Nb in insufficient amounts brings about little of such effects, Nb content at 0.03% or higher is preferable. However, excessively high Nb content blocks growth of crystal grains during annealing, impairing formability rather than improving it. Hence, the upper limit of Nb content is set at 0.1%, or more preferably, at 0.05%.

B: up to 0.005%

Although B is not among the essential elements, it is added as necessary because of its ability to hold in check brittleness that may sometimes occur to ultra-low carbon steel when it is formed. Addition of B at 0.0005% or higher is desirable to ensure the effect as described above. When B is added in excess of 0.005%, not only its effect reaches a saturation point but also the formability of the base metal is impaired. Hence, the upper limit is preferably set at 0.005%.

Constituents of the base metal, other than the aforesaid elements, are Fe and incidental impurities.

(B) Average Grain Size on the Surface of the Base Metal

The finer the grain size on the surface of the base metal, at the interface between the base metal and the galvannealed coating, the higher the coating adhesion becomes. The coating adhesion is further improved by adding an adequate amount of Si to the base metal to provide a fine grained micro-structure. This has been realized by the present invention.

In order to improve chipping resistance, the average grain size on the surface of base metal is set at 12 $\mu$m or less. It is most preferable that the surface of the base metal is composed of a uniform fine grained micro-structure, but even in the case of a micro-structure wherein fine grains and grains of ordinary sizes coexist, good chipping resistance is achieved as long as the average grain size is 12 $\mu$m or less. With the average grain size at 7 $\mu$m or less, the coating adhesion is further improved. However, when the average grain size is reduced to less than 1 $\mu$m, further improvement in the coating adhesion does not occur. In addition, it is practically difficult to manufacture steel sheets which average grain size is less than 1 $\mu$m in diameter.

The average grain size on the surface of the base metal of the galvannealed steel sheet is measured by the method described hereafter. The galvannealed coating of the steel sheet is removed by immersing same in a 2 to 12 wt % hydrochloric acid solution with addition of an inhibitor at least 0.5 wt %, in order to restrain excessive dissolution (hereafter, % used in expressing concentration of solute in a solution denotes wt %). After removal of the galvannealed coating, the base metal is immersed in 2 to 5% nitric acid-alcohol solution for 12 to 180 seconds, causing the surface of the base metal to be etched. Then photographs are taken of the surface of the base metal with an optical or electron microscope of a 1000× magnification, and the number of grains crossed by a straight line 100 mm long, drawn around the center of each photograph, is counted. The average diameter of grains is found by averaging the measured results obtained with respect to at least ten visual fields.

The grain size deep inside the base metal has no effect on the coating adhesion, and may be optional in size. Nevertheless, the grain size of inside of the base metal may preferably be set to the adequate large size sufficient to provide the necessary properties required of steel sheets such as formability, other than coating adhesion. No particular strength of products is specified. However, the invention is most preferably applied to materials having tensile strengths of about 400 MPa or lower in practice. Further, from a practical viewpoint, the tensile strength of the steel sheet may preferably be set at 280 MPa or higher.

(C) Manufacturing Method

A cold rolled steel sheet may preferably be used as a base metal for the galvannealed steel sheet according to the invention. However, a steel sheet annealed after cold rolling or a hot rolled steel sheet after removal of scales may also be used. The galvannealed steel sheet according to the invention can be manufactured by means of a hot-dip galvanizing line and a Fe—Zn alloying furnace which are in general use. Preferable conditions for plating and Fe—Zn alloying in manufacturing process are described hereafter.

(a) Grinding of the Surface of the Base Metal

The surface of the base metal before reduction heating does not necessarily need to be ground. However, by grinding the surface of the base metal before reduction heating, grain size on the surface of the base metal after Fe—Zn alloying treatment tend to become finer. Hence, such grinding is preferable. In order to achieve the aforesaid effect of grinding, it is preferable to grind 1 g or more per 1 $m^2$ of ground surface area. When grinding more than 8 g per 1 $m^2$ of the ground surface area, the effect of promoting reduction of grain size reaches a saturation point. Furthermore, economics is impaired because grinding facilities need to be upgraded and difficulty is encountered in disposing steel shavings generated by grinding. Hence, in case of grinding, it is preferable to grind the surface of the base metal by an amount in the range of 1 to 8 g/$m^2$ of the surface area.

Any of grinding methods including grinding brush, grinding belt, and shot blast may be employed. Among them, a method of grinding by rotary brushes provided with abrasive grains is quite effective. Further, grinding may preferably be performed before or in the degreasing bath equipped in the hot-dip galvanizing line because steel shavings generated by grinding and grease adhering to the surface of the base metal are removed easily.

The reason for the grain size becoming smaller by grinding the surface of the base metal before reduction heating is still unclear. It is presumed that work strain generated on the surface of the base metal by the grinding remains after the reduction heating, and the strain has an effect on the diffusion of Zn into the base metal and formation of a fine grained micro-structure.

(b) Cooling after Reduction Heating

By heating the base metal in a reducing atmosphere to 600° C. or above, the surface thereof is reduced. In case of recrystallization being required, the base metal is heated to a recrystallization temperature or above in the course of the reduction heating, and held at the temperature for a time period necessary for completing recrystallization. In the case of recrystallization being required, a heating temperature in the range where 700 to 900° C. is preferable. In the case of only reduction of the surface of the base metal is necessary, a heating temperature in the range of 600 to 700° C. is preferable. After reduction heating, the base metal is cooled down to a temperature range suitable for the hot-dip galvanizing process. In the course of such cooling, it is preferable to hold the base metal in the temperature range of 600 to 500° C. for 10 to 120 seconds. Such treatment assists formation of a fine grained micro-structure on the surface of the base metal after the Fe—Zn alloying treatment, improving coating adhesion. Holding the base metal at a temperature exceeding 600° C. or under 500° C. does not promote formation of a fine grain structure. Further, a retention time of 10 seconds or longer is preferable. When the retention time exceeds 120 seconds, the effect reaches a saturation point, and a longer cooling stage requires corresponding modification of facilities, leading to a higher production cost.

Thereafter, the base metal is further cooled to a temperature close to the temperature of a plating bath, and immersed in a hot-dip galvanizing bath for plating. Chemical composition of the plating bath may be optional, but in case of Si content of the base metal being 0.08% or higher, an amount of Al dissolved in the plating bath (total amount of Al minus an amount of Al alloyed with Fe and the like) may preferably be reduced to the range of 0.08 to 0.12%. This is because as the Si content in the base metal increases, the velocity of Fe—Zn alloying slows down. A coating weight of a galvannealed steel sheet is generally 20–70 g/m$^2$ of the surface area of the steel sheet. However, the coating weight of the galvannealed steel sheet according to the invention may be optional.

(c) Heating Velocity at the Fe—Zn Alloying Treatment

The steel sheet is heated up after the hot-dip galvanizing, and the Fe—Zn alloying treatment is applied to the metallic coating thereof. Concentration of Al in the hot-dip galvanizing bath and the processing conditions in the Fe—Zn alloying treatment, such as the maximum temperature reached in such treatment and the retention time at the alloying temperature, are generally controlled so that Fe content of a galvannealed coating falls normally in the range of 7 to 18%, preferably 8 to 12%.

A velocity of heating up the galvanized steel sheet in the Fe—Zn alloying treatment has an effect on formation of a fine grained micro-structure on the surface of the base metal. At a slow heating velocity, formation of the fine grained micro-structure may sometimes be insufficient. In the case of the base metal of high P content, in particular, coating adhesion tends to become unstable. Hence, the average heating velocity of the galvanized steel sheet may preferably be set at 20° C. or more/sec in the temperature range of 420 to 480° C.

A reason for formation of the fine grained micro-structure by heating up the galvanized steel sheet at said range of velocity has not been established as yet, but presumably the following may be the reason. One of the factors for formation of the fine grained micro-structure on the surface of the base metal is considered to be diffusion of Zn into the base metal. When the heating velocity is slowed down in the temperature range of 420 to 480° C. during the Fe—Zn alloying treatment, η phase, that is, a Zn phase containing a small amount of solute Fe, disappears from the coated later in a low temperature range, while alloy phases with high Fe content such as Γ and Γ 1 are easily formed. The Γ and Γ 1 act to block diffusion of Zn into the base metal. Rapid heating in the low temperature range during the Fe—Zn alloying treatment delays the disappearance of the η phase, and the η phase remains on the surface of the base metal even at a high temperature, promoting diffusion of Zn into the base metal.

Any heating velocity of 20° C./sec or more may be used although there are limitation owing to available facilities and from the viewpoint of controlling the velocity. In practice, a heating velocity of 70° C./sec or less may be sufficient. The heating velocity in a temperature range lower than 420° C. has little effect on formation of the fine grained micro-structure. A Fe—Zn alloying velocity becomes faster at a temperature range exceeding 480° C., and the fine grained micro-structure is formed sufficiently. Hence, the heating velocity in the temperature range exceeding 480° C. may be optional.

A heating temperature for the Fe—Zn alloying treatment may preferably be in the range of 480 to 600° C. Fe—Zn alloying becomes insufficient in a temperature range below 480° C., and a soft ξ phase tends to remain on the surface of the galvannealed coating. The soft ξ phase remained on the surface of the galvannealed coating impairs slidableness of the steel sheet against a die during press forming. Then, the steel sheet becomes susceptible to powdering and its formability is impaired. In a temperature range exceeding 600° C., a velocity at which the Γ phase is formed becomes faster, reducing the amount of Zn introduced into the base metal. The Fe—Zn alloying temperature may more preferably be between 480° C. and 550° C.

Manufacturing conditions in general use may be adopted except for those described in the foregoing. The galvannealed steel sheet having excellent coating adhesion is manufactured in accordance with the manufacturing method described above.

Embodiments 16 different kinds of ultra-low carbon steels, of which chemical compositions are shown in Table 1, were produced on a laboratory scale, and by applying hot rolling and cold rolling processes thereto, unannealed cold rolled steel sheets 0.8 mm thick were obtained.

Several testpieces 80 mm wide and 200 mm long were prepared from each of the cold rolled steel sheets. The surfaces of some of the testpieces were ground by a nylon brush roll with abrasive grains under the condition of 1 to 8 passes. An amount of grinding determined from a difference in weight between before and after grinding was in the range of 1 to 8 g/m$^2$ of the surface area of the base metal on one side. Hot-dip galvanizing was applied to the ground testpieces and to the not ground testpieces using a hot-dip galvanizing testing apparatus under the conditions described hereafter.

Firstly for preheating, the testpieces were heated up to 550° C. in a nitrogen atmosphere with the velocity of 15° C./sec. Then, the testpieces were heated further to 800° C. with the velocity of 15° C./sec in an atmosphere of 10 volume % of hydrogen and 90 volume % of nitrogen (dew point:—60° C. or below) for a retention time of 20 sec, thus reducing the surface of the base metal, and completing recrystallization at the same time.

TABLE 1

| Specimen Steel | Chemical Composition (wt %) Balance:Fe and Incidental Impurities | | | | | | | | Tensile Strength | |
|---|---|---|---|---|---|---|---|---|---|---|
| Mark | C | Si | Mn | P | Ti | Nb | Al | B | (MPa) | Remark |
| A | 0.003 | 0.05 | 0.42 | 0.018 | 0.015 | — | 0.030 | — | 280 | |
| B | 0.003 | 0.10 | 0.28 | 0.020 | 0.035 | — | 0.020 | — | 330 | |
| C | 0.003 | 0.13 | 0.30 | 0.018 | 0.016 | 0.008 | 0.025 | — | 340 | |
| D | 0.004 | 0.03 | 0.14 | 0.021 | 0.008 | 0.022 | 0.032 | — | 340 | Examples of the |
| E | 0.004 | 0.08 | 0.18 | 0.021 | 0.007 | 0.021 | 0.041 | — | 350 | Invention |
| F | 0.003 | 0.15 | 0.22 | 0.025 | 0.010 | 0.025 | 0.030 | — | 350 | |
| G | 0.002 | 0.10 | 0.30 | 0.035 | 0.012 | — | 0.030 | 0.0008 | 340 | |
| H | 0.004 | 0.20 | 0.15 | 0.035 | 0.005 | 0.012 | 0.025 | — | 360 | |
| I | 0.003 | 0.08 | 0.18 | 0.040 | 0.009 | 0.009 | 0.030 | 0.0011 | 350 | |
| J | 0.002 | 0.13 | 0.50 | 0.040 | 0.025 | — | 0.035 | — | 350 | |
| K | 0.003 | 0.08 | 1.20 | 0.050 | 0.025 | — | 0.040 | — | 360 | |
| L | 0.005 | 0.15 | 0.90 | 0.095 | 0.010 | 0.020 | 0.050 | — | 400 | |
| M | 0.008 | 0.13 | 0.75 | 0.090 | 0.040 | — | 0.040 | — | 400 | |
| N | 0.003 | 0.12 | 0.90 | 0.076 | 0.016 | 0.020 | 0.051 | 0.0018 | 390 | |
| O | 0.003 | *0.01 | 0.51 | 0.017 | 0.008 | — | 0.055 | — | 250 | Examples of the |
| P | 0.003 | *0.35 | 0.21 | 0.044 | 0.011 | 0.006 | 0.017 | — | 420 | Comparison |

note)
* Denotes outside the range specified by the invention.

Thereafter, the testpieces were cooled down to 600° C. in the same atmosphere as above, and further cooled by varying a cooling velocity in the temperature range of 600 to 500° C. to check the effect of the retention time in such a range. After further cooling to a temperature range of 460 to 480° C. in the same atmosphere, the hot-dip galvanizing process was applied to the testpieces.

The hot-dip galvanizing process was applied under conditions that the testpieces were immersed in a galvanizing bath, which contains 0.08 to 0.18 wt % of Al dissolved in the bath, at 460° C. for a retention time of 1 to 5 seconds. The testpieces after being galvanized were heated to an Fe—Zn alloying temperature, which is in the range of 480 to 600° C., by means of directly electrifying the galvanized testpieces. During such heating, a heating velocity in the temperature range of 420 to 480° C. was variously altered in order to check the effect of the heating velocity on coating adhesion. Thereafter, the testpieces were cooled down to room temperature at a cooling velocity of 4 to 10° C./sec.

Fe content of the galvannealed coating was found in the range of 8 to 15 wt %, and weight of the galvannealed coating was in the range of 25–75 g /$m^2$ of the surface area on one side.

The grain size on the surface of the base metal of respective testpieces after application of the Fe—Zn alloying treatment was observed by the following method. The galvannealed coating of the testpiece was dissolved in a 6 wt % hydrochloric acid solution containing 0.01 wt % inhibitor, and removed. Then the base metal was held in 3% nitric acid-alcohol solution for 2 min, causing the surface thereof to be etched. Photographs of the etched surface were taken by an electron microscope of 1000× magnification with respect to ten visual fields, and the average grain size was determined by counting the number of grains crossed by a straight line 100 mm long, drawn around the center of each photograph.

Chipping resistance was evaluated by the following test method. Galvannealed testpieces 70 mm wide and 150 mm long were phosphatized (coating weight: 3 to 7 g/$m^2$) using a phosphatizing solution available on the market. Then a three-coat three-bake coating (total thickness: in the order of 100 $\mu$m) consisting of an under coat 20 $\mu$m thick, an intermediate coat 35 to 40 $\mu$m thick, and a top coat 35 to 40 $\mu$m thick was applied using a cation electrophoretic paint.

Testpieces of painted steel sheets thus obtained were cooled to −20° C., and each of the testpieces were struck against ten pebbles, each 4 to 6 mm in diameter, at a collision velocity of 100 to 150 km/h and under an atmospheric pressure of 2.0 kg/$cm^2$ by means of the gravel test apparatus. Then, the diameters of each of broken pieces of coating exfoliated from the point of collision were measured and the mean diameter was calculated. Chipping resistance was evaluated according to the mean diameter as follows:

| mark | mean diameter | judgment |
|---|---|---|
| ⊙ + | less than 2.0 mm | excellent |
| ⊙ | 2.0–less than 3.0 mm | better |
| ○ | 3.0–less than 4.0 mm | good |
| Δ | 4.0–less than 5.0 mm | slightly poor |
| X | 5.0 mm or more | poor |

Powdering resistance was evaluated by the following method. A testpiece in the shape of a circle 60 mm in diameter was punched out from each of galvannealed testpieces, and press formed into a cylindrical cup by use of a die provided with a punch 30 mm in diameter, and a die shoulder 3 mm in radius. A total weight of coating peeled off by an adhesive tape from the external surface of the side wall of each of the cylindrical cup was measured. Powdering resistance was evaluated according to the results as follows:

| mark | weight of peeled coating | judgment |
|---|---|---|
| ⊙ | less than 15 mg | better |
| ○ | 15–less than 25 mg | good |
| Δ | 25–less than 35 mg | slightly poor |
| X | 35 mg or more | poor |

Plating conditions and the results of various evaluation tests are shown in Table 2. In Table 2, "retention time at cooling " represents a length of time for the base metal to reside in the temperature range of 600 to 500° C. in the cooling stage following the reduction annealing, and "heating velocity in Alloying Condition" represents a heating velocity in the temperature range of 420 to 480° C.

TABLE 2

| Test No. | Steel Mark | Amount of Grinding ($g/m^2$) | Retention Time at Cooling (sec) | Coating Weight ($g/m^2$) | Alloying Condition: Heating Speed (° C./sec.) | Alloying Condition: Cooling Speed (° C./sec.) | Alloying Condition: Alloying Temperature (° C.) | Alloying Condition: Fe content (wt %) | Surface Grain Size (μm) | Coating Properties: Chipping Resistance | Coating Properties: Powdering Resistance |
|---|---|---|---|---|---|---|---|---|---|---|---|
| 1 | A | 1 | 20 | 45 | 45 | 5 | 480 | 8 | 9 m | ◎ | ◎ |
| 2 | A | 2 | 10 | 30 | 30 | 10 | 510 | 9 | 8 m | ◎ | ◎ |
| 3 | A | 4 | 30 | 60 | 55 | 5 | 520 | 9 | 8 m | ◎ | ◎ |
| 4 | B | 1 | 30 | 55 | 55 | 5 | 520 | 10 | 8 m | ◎ | ◎ |
| 5 | B | 5 | 15 | 35 | 25 | 5 | 550 | 12 | 8 u | ◎ | ◎ |
| 6 | C | 2 | 30 | 60 | 55 | 5 | 520 | 9 | 5 u | ◎ | ◎ |
| 7 | C | 1 | 30 | 40 | 20 | 5 | 550 | 10 | 7 u | ◎ + | ◎ |
| 8 | C | 3 | 20 | 35 | 55 | 5 | 520 | 12 | 7 u | ◎ + | ◎ |
| 9 | D | 2 | 30 | 60 | 50 | 5 | 520 | 9 | 12 m | ◎ | ◎ |
| 10 | D | 1 | 60 | 40 | 20 | 5 | 550 | 10 | 10 m | ◎ | ◎ |
| 11 | D | 3 | 15 | 35 | 25 | 5 | 580 | 12 | 9 m | ◎ | ◎ |
| 12 | E | 8 | 60 | 35 | 80 | 5 | 600 | 12 | 2 u | ◎ + | ◎ |
| 13 | F | 1 | 30 | 60 | 50 | 10 | 520 | 9 | 6 u | ◎ + | ◎ |
| 14 | F | 4 | 60 | 40 | 30 | 5 | 550 | 10 | 5 u | ◎ + | ◎ |
| 15 | F | 3 | 60 | 25 | 30 | 5 | 530 | 13 | 4 u | ◎ + | ◎ |
| 16 | G | 1 | 30 | 60 | 50 | 10 | 520 | 9 | 6 u | ◎ + | ◎ |
| 17 | H | 3 | 60 | 40 | 80 | 5 | 550 | 11 | 5 u | ◎ + | ◎ |
| 18 | H | 2 | 60 | 25 | 30 | 5 | 530 | 15 | 4 u | ◎ + | ◎ |
| 19 | I | 4 | 60 | 40 | 30 | 5 | 550 | 10 | 5 u | ◎ + | ◎ |
| 20 | J | 4 | 60 | 25 | 30 | 5 | 530 | 13 | 4 u | ◎ + | ◎ |
| 21 | K | 2 | 30 | 60 | 50 | 10 | 520 | 9 | 4 u | ◎ + | ◎ |
| 22 | L | 1 | 60 | 40 | 30 | 5 | 550 | 10 | 5 u | ◎ + | ◎ |
| 23 | M | 1 | 60 | 40 | 30 | 5 | 550 | 10 | 5 u | ◎ + | ◎ |
| 24 | N | 0 | 60 | 25 | 30 | 5 | 530 | 13 | 4 u | ◎ + | ◎ |
| 25 | * O | 2 | 10 | 60 | 25 | 4 | 520 | 13 | * 15 | X | Δ |
| 26 | * P | 0 | non - galvanization occurred | | | | | | | | |
| 27 | J | 0 | 7 | 45 | 20 | 5 | 510 | 15 | * 25 | X | X |
| 28 | H | 1 | 7 | 75 | 10 | 6 | 520 | 12 | * 14 m | Δ | Δ |
| 29 | I | 5 | 8 | 60 | 10 | 4 | 520 | 10 | * 25 m | Δ | X |
| 30 | M | 8 | 20 | 55 | 8 | 8 | 490 | 12 | * 20 m | X | X |

| Test No. | Synthetic Judgement | Remark |
|---|---|---|
| 1 | ◎ | Examples of the Invention |
| 2 | ◎ | |
| 3 | ◎ | |
| 4 | ◎ | |
| 5 | ◎ | |
| 6 | ◎ | |
| 7 | ◎ | |
| 8 | ◎ | |
| 9 | ◎ | |
| 10 | ◎ | |
| 11 | ◎ | |
| 12 | ◎ | |
| 13 | ◎ | |
| 14 | ◎ | |
| 15 | ◎ | |
| 16 | ◎ | |
| 17 | ◎ | |
| 18 | ◎ | |
| 19 | ◎ | |
| 20 | ◎ | |
| 21 | ◎ | |
| 22 | ◎ | |
| 23 | ◎ | |
| 24 | ◎ | |
| 25 | X | Examples of the Comparison |
| 26 | X | |
| 27 | X | |
| 28 | X | |
| 29 | X | |
| 30 | X | |

note)
* Denotes outside of the range specified by the invention.
Surface Grain Size u:uniform structure, m:mixed structure.

In Table 1, typical values of tensile strength of galvannealed steel sheets found by this test are shown. These tensile strength were measured using the tensile testpiece No. 5 as specified by JIS-Z-2201.

As the test results show, tensile strengths of steel sheets made of steel samples A to N, which chemical compositions are in the range specified by the invention, fall in the range of 280–400 MPa, corresponding to a range of preferable strength of steel sheets for use in automobiles.

Testpieces numbered from 1 through 24, prepared from the galvannealed steel sheets manufactured by the method of the invention, had fine grained micro-structures on the surface of respective base metals. The respective testpieces had excellent chipping resistance as well as powdering resistance. Further, with respect to the testpieces numbered 7, 8 and from 12 through 24, having the average grain size less than 7 μm on the surface of the respective base metal, the mean value of diameters of exfoliated pieces of the coating at a low temperature chipping test was found to be less than 2 mm, demonstrating excellent chipping resistance.

On the other hand, in the cases of the following testpieces, the average grain size on the surface of respective base metals was found to be large, and the galvannealed coating adhesion of the respective testpieces was inferior:

Testpiece No. 25 prepared from a steel having low Si content denoted by "○";

Testpiece No. 27 prepared by applying the reduction and annealing processes without prior grinding of the surface of its base metal, and cooling thereafter for a short retention time;

Testpieces Nos. 28 and 29 prepared by cooling for a short retention time after the reduction and annealing processes, and by applying the Fe—Zn alloying treatment with a low heating velocity; and As the test results show, tensile strengths of steel sheets made of steel sample A to N, which chemical compositions are in the range specified by the invention, fall in the range of 280–400 MPa, corresponding to a range of preferable strength of steel sheets for use in automobiles.

Testpiece No. 30 prepared by applying the Fe—Zn alloying treatment with a low heating velocity. In the case of testpiece No. 26, prepared from a steel denoted by "P" having excessive Si content, non-galvanization occurred, and consequently, no further evaluation was made.

As is obvious from the test results described in the aforementioned, the galvannealed steel sheet, wherein chemical composition of the base metal falls within the range specified by the present invention, and a mean value of the grain size on the surface of the base metal, at the interface between the base metal and the galvannealed coating, is 12 μm or less, has excellent chipping resistance and powdering resistance. It has also been found that the galvannealed steel sheet having excellent coating adhesion is manufactured by prior grinding of the surface of the base metal, reducing at a high temperature, and controlling subsequent cooling conditions and Fe—Zn alloying conditions.

INDUSTRIAL APPLICABILITY

The galvannealed steel sheet according to the invention has excellent powdering resistance during press forming, and excellent chipping resistance after painting applied thereto. The steel sheet according to the invention, wherein use of inexpensive P is used for increasing the strength of the steel, also excels in economics as steel sheet of high tensile strength. Furthermore, the steel sheet according to the invention, based on an ultra-low carbon steel, has excellent formability. In addition, the steel sheet is manufactured economically and easily by grinding the surface of a base metal before galvanizing, and regulating conditions of galvanizing process.

What is claimed is:

1. A galvannealed steel sheet, comprising a base metal and a galvannealed coating, which is formed on the surface of the base metal, wherein the base metal has the following chemical composition on the basis of percent by weight and the average grain size on the surface of the base metal is 7 μm or less:

C: up to 0.01%; Si: 0.03 to 0.3%;

Mn: 0.05 to 2%; P: 0.017 to 0.15%;

Al: 0.005 to 0.1%; Ti: 0.005 to 0.1%;

Nb: up to 0.1%; B: up to 0.005%;

balance: Fe and incidental impurities;

wherein the average grain size on the surface of the base metal is finer than the grain size below the surface of the base metal.

2. A galvannealed steel sheet according to claim 1, wherein, on the basis of percent by weight, the content of Si in the base metal ranges between 0.03 to 0.18%.

3. A galvannealed steel sheet according to claim 1, wherein the average grain size on the surface of the base metal is 1 μm or more.

4. A galvannealed steel sheet according to claim 1, wherein the steel sheet is a hot rolled sheet or a cold rolled sheet.

5. A galvannealed steel sheet according to claim 1, wherein the base metal has a ground surface in contact with the galvannealed coating.

6. A galvannealed steel sheet according to claim 1, wherein the P content is 0.02 to 0.04%.

7. A galvannealed steel sheet according to claim 1, wherein the Ti content is 0.005 to 0.05%.

8. A galvannealed steel sheet according to claim 1, wherein the Nb content is 0.03 to 0.05%.

9. A method of manufacturing a galvannealed steel sheet, comprising a base metal, which has the following chemical composition on the basis of percent by weight and the average grain size on the surface of the base metal being 12 μm or less, and a galvannealed coating formed on the surface of the base metal, which comprises the steps of:

(a) heating a base metal to a temperature of 600 to 900° C. in a hydrogen contained atmosphere, thereby reducing the surface of the base metal;

(b) retaining the base metal in a temperature range of 600 to 500° C. for 10 to 120 seconds in the cooling stage following said heating, and immersing the base metal in a hot dip galvanizing bath; and (c) heating the galvanized steel sheet to a Fe—Zn alloying temperature with the velocity of 20° C./sec or more in the temperature range of 420 to 480° C.:

C: up to 0.01%; Si: 0.03 to 0.3%;

Mn: 0.05 to 2%; P: 0.017 to 0.15%;

Al: 0.005 to 0.1%; Ti: 0.005 to 0.1%;

Nb: up to 0.1%; B: up to 0.005%;

balance: Fe and incidental impurities.

10. A method of manufacturing a galvannealed steel sheet according to claim 9, wherein, on the basis of percent by weight, the content of Si in the base metal ranges between 0.03 to 0.18%.

11. A method of manufacturing a galvannealed steel sheet according to claim 9, wherein the average grain size on the surface of the base metal is 7 μm or less.

12. A method of manufacturing a galvannealed steel sheet, according to claim 10, further comprising a step of removing 1 to 8 g/m$^2$ of the surface of the base metal by grinding, prior to step (a).

13. A method of manufacturing a galvannealed steel sheet according to claim 9, wherein the base metal is heated to 700 to 900° C. in step (a).

14. A method of manufacturing a galvannealed steel sheet according to claim 9, wherein the base metal includes at least 0.08% Si and the hot dip galvanizing bath includes 0.08 to 0.12% Al.

15. A method of manufacturing a galvannealed steel sheet according to claim 9, wherein after step (c) the galvannealed coating contains 7 to 18% Fe.

16. A method of manufacturing a galvannealed steel sheet according to claim 9, wherein in step (c) the average grain size on the surface of the base metal is made finer.

17. A method of manufacturing a galvannealed steel sheet according to claim 9, wherein in step (c) heating is continued until the galvannealed steel sheet is heated to a temperature above 480° C. but below 600° C.

* * * * *